United States Patent [19]

Akiyoshi et al.

[11] Patent Number: 4,837,120

[45] Date of Patent: Jun. 6, 1989

[54] ELECTROPHOTOGRAPHIC PHOTOCONDUCTOR HAVING CYLINDRICAL BASE SUPPORT OF SPECIFIC PHENOL RESIN

[75] Inventors: Hideki Akiyoshi, Numazu; Hiroshi Tamura, Fujsawa; Atsushi Kutami; Yoshihiro Takada, both of Numazu, all of Japan

[73] Assignee: Ricoh Company, Ltd., Tokyo, Japan

[21] Appl. No.: 122,449

[22] Filed: Nov. 19, 1987

[30] Foreign Application Priority Data

Nov. 19, 1986 [JP] Japan ..... 61-273983
Nov. 19, 1986 [JP] Japan ..... 61-273984

[51] Int. Cl.[4] ..... G03G 5/00
[52] U.S. Cl. ..... 430/56; 29/132
[58] Field of Search ..... 430/56; 523/328; 524/908; 428/36; 29/132

[56] References Cited

U.S. PATENT DOCUMENTS 3,895,944 7/1975 Wiedemann ..... 430/58

OTHER PUBLICATIONS

Encyclopedia of Polymer Science, etc., vol. 10, pp. 64, 65 (1969).

*Primary Examiner*—J. David Welsh
*Attorney, Agent, or Firm*—Oblon, Fisher, Spivak, McClelland & Maier

[57] ABSTRACT

An improved electrophotographic photoconductor is disclosed, which comprises a cylindrical electroconductive support and a photoconductive layer formed on the electroconductive support, which electroconductive support comprises a base support made of a phenol resin with the releasing rate of ammonia therefrom per 48 hours being 50 ppm or less.

9 Claims, 1 Drawing Sheet

ELECTROPHOTOGRAPHIC PHOTOCONDUCTOR HAVING CYLINDRICAL BASE SUPPORT OF SPECIFIC PHENOL RESIN

BACKGROUND OF THE INVENTION

The present invention relates to an electrophotographic photoconductor comprising a support and a photoconductive layer formed on the support, more particularly to an electrophotographic photoconductor comprising a support made of a phenol resin which releases substantially no ammonia or a minimized amount of ammonia.

Currently organic electrophotographic photoconductors comprising a support and a photoconductive layer comprising an organic photoconductive material formed on the support are more used than inorganic electrophotographic photoconductors comprising a support and an inorganic photoconductive layer containing an inorganic photoconductive material therein. This may be because such inorganic electrophotographic photoconductors are produced by a very costly method, such as vacuum deposition and glow discharge, particularly when forming its photoconductive layer. In contrast to this, in the organic electrophotographic photoconductors, the photoconductive layer can be produced by a less costly coating method and accordingly the organic electrophotographic photoconductors are less expensive than the inorganic electrophotographic photoconductors.

However, even if the cost for forming an organic photoconductive layer on a support is less than that for forming inorganic photoconductive layer, the cost of the support for use in the organic electrophotographic photoconductor is still high and predominant in the total cost of the organic electrophotographic photoconductor and therefore there is a demand for an inexpensive support for organic electrophotographic photoconductors.

For the purpose of meeting this demand, Japanese Laid-Open Patent Application No. 58-30764 proposes a pipe made of a phenol resin as the support of an organic electrophotographic photoconductor as meeting the requirements for such photoconductors, such as being light in weight, electroconductive, non-magnetic, and heat resistant and having high dimensional stability. There are two types of phenol resin, a resol type and a novolak type. It is considered that the novolak type is better than the resol type in the dimensional stability, surface properties and workability.

However, an electrophotographic photoconductor comprising a support in the shape of a pipe made of a novolak type phenol resin, an undercoat layer, a charge generating layer, and a charge transporting layer, which layers are successively overlaid on the support, has the shortcomings that the photosensitivity is poor and the residual potential increases while in use.

SUMMARY OF THE INVENTION

It is therefore an object of the present invention to provide an improved electrophotographic photoconductor comprising a support made of a phenol resin, from which the above-mentioned conventional shortcomings are eliminated.

The above object of the present invention is attained by use of a cylindrical support comprising a base support made of a phenol resin with the releasing rate of ammonia therefrom per 48 hours being 50 ppm or less, as the support of the electrophotographic photoconductor.

DETAILED DESCRIPTION OF THE PREFERRED EMBODIMENTS

In the present invention, a phenol resin with the releasing rate of ammonium per 48 hours being 50 ppm or less is employed as the material for a support of an organic electrophotographic photoconductor. This invention is based on the discovery that the conventional problems, when using a phenol resin as the material for a support of an organic electrophotographic photoconductor, are caused by the ammonia released from the phenol resin.

A conventional novolak type phenol resin contains ammonia as a residual component. In order to remove the residual ammonia, it is necessary to subject the resin to heat treatment or boil the resin in water. In contrast to this, the resol type phenol resin, does not contain such residual ammonia. Therefore it can be used as it is as the material for the support of an organic electrophotographic photoconductor.

For the purpose of comparative tests, cylinders made of a variety of phenol resins were subjected to heat treatment or boiled in water to adjust the releasing rate of ammonia from the resins. Using such cylinders as base support, a variety of organic electrophotographic photoconductors were made and their electrophotographic characteristics were investigated.

Specifically, (i) the relationship between the photosensitivity $E_{1/10}$ and the releasing rate of ammonia from the phenol resin support and (ii) the relationship between the residual potential $V_R$ and the releasing rate of ammonia from the phenol resin support were investigated.

Figure 1:
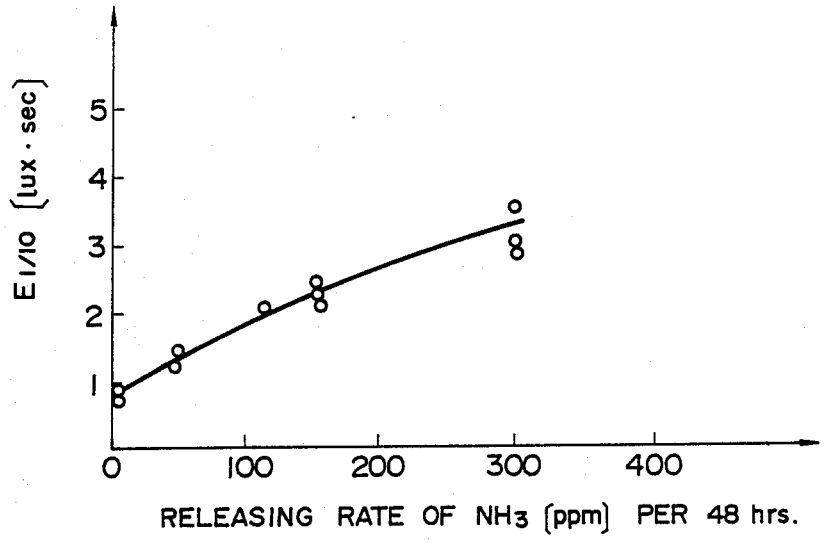
FIG. 1 is a graph showing the relationship between the photosensitivity $E_{1/10}$ and the releasing rate of ammonia from the phenol resin supports of electrophotographic photoconductors at the initial use thereof.
Figure 2:
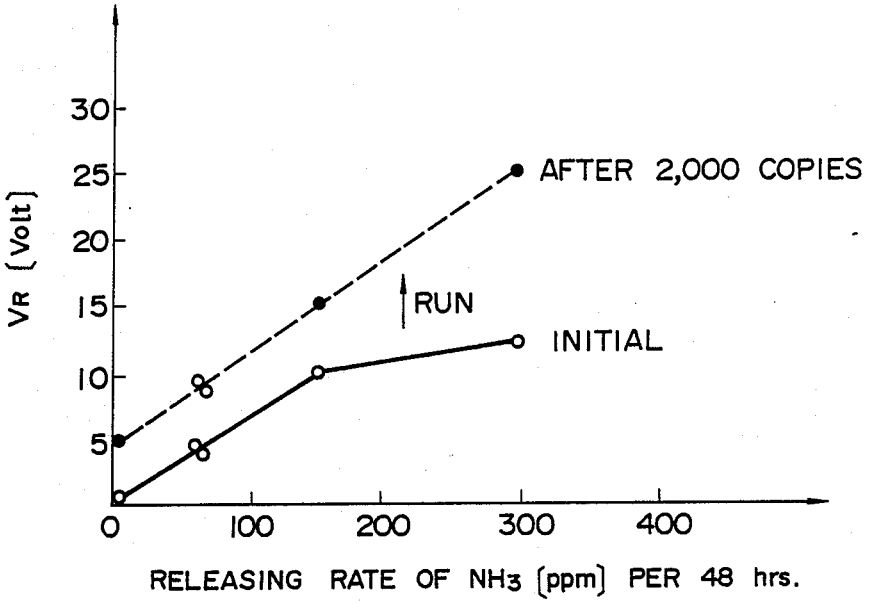
FIG. 2 is a graph showing the relationship between the residual potential $V_R$ and the releasing rate of ammonia from the phenol resin supports of the electrophotographic photoconductors at the initial use thereof and that after making 2,000 copies by use of the photoconductors.

FIG. 1 shows the relationship between the photosensitivity $E_{1/10}$ and the releasing rate of ammonia at the initial use of the photoconductors. FIG. 2 shows the relationship between the residual potential $V_R$ and the releasing rate of ammonia at the initial use of the photoconductors and the same relationship after making 2,000 copies by use of the photoconductors.

The results shown in FIGS. 1 and 2 indicate that the less the releasing amount of $NH_3$, the better the electrophotographic characteristics. For practical use, it is preferable that the releasing rate of $NH_3$ from the phenol resin support be 50 ppm or less per 48 hours. The best thing is that the phenol resin for the support releases no ammonia.

In the above tests, cylindrical supports were made of the following phenol resins: (1) A resol type phenol resin, which is free from ammonia, accordingly releases no ammonia. The cylindrical support employed is the same as that in Example 3 as will be explained later.

(2) A phenol resin with the releasing rate of ammonia per 48 hours being 50 ppm. The cylindrical support employed is the same as that employed in Example 1 as will be explained later.

(3) A phenol resin with the releasing rate of ammonia per 48 hours being 150 ppm. The cylindrical support employed is the same support as that employed in Example 1 except that the thickness thereof is changed to 2 mm.

(4) A phenol resin with the releasing rate of ammonia per 48 hours being 300 ppm. The cylindrical support employed is the same support as that employed in Example 1 except that the support is not boiled in water.

Each of the electrophotographic photoconductors employed in the above tests comprises any of the above-mentioned supports, an electroconductive layer formed thereon, an intermediate white pigment layer, a charge generating layer and a charge transporting layer, which layers are successively overlaid on the support. Each of the layers is exactly the same as that in Example 1 which is explained later.

The releasing rate of ammonia in the above-mentioned supports was measured as follows. Each cylindrical support was tightly wrapped with a plastic film and sealed. It was allowed to stand at 25° C. for 48 hours. The concentration of ammonia contained in 100 ml of the gases in the hollow portion or the sealed cylindrical support was measured by a Kitagawa type gas detector.

The photosensitivity $E_{1/10}$ and the residual potential $V_R$ of each electrophotographic photoconductor were measured in the same manner as in Example 1.

The cylindrical support made of the phenol resin can be made by extrusion molding, injection molding and compression molding.

When it is necessary to make the cylindrical support electroconductive, finely-divided electroconductive particles, such as carbon black and graphite, may be added to the phenol resin of the cylindrical support.

When it is necessary to improve the heat resistance and dimensional stability of the support, finely-divided inorganic materials such as silica powder, aluminum oxide powder, finely-divided organic materials such as wood powder, and glass fiber may be added to the phenol resin of the cylindrical support.

When the cylindrical support itself is not electroconductive, an electroconductive layer made of, for instance, aluminum, nickel, chrome, tin oxide or indium oxide, may be deposited on the support by vacuum deposition. As such an electroconductive layer, a layer comprising finely-divided electroconductive particles of metals, carbon black, zinc oxide, titanium oxide, tin oxide, or indium oxide, and a resin binder in which such electroconductive particles are dispersed, may also be employed.

An undercoat layer may be interposed between such an electroconductive support and a photoconductive layer. As such an undercoat layer, (i) a resin layer made of, for instance, polyamide such as nylon 66, nylon 610 and copolymer nylon, polyurethane, polyvinyl alcohol, and (ii) an electroconductive resin layer comprising any of the above resins and finely-divided inorganic particles of titanium oxide, zinc oxide and magnesium oxide, may be employed.

As the photoconductive layer, both a single-layer type in which a charge generating material and a charge transporting material are mixed, and a double-layer type comprising (a) a charge generating layer containing a charge generating material and (a) a charge transporting layer containing a charge transporting layer may be employed.

An electrophotographic photoconductor comprising a double-layered photoconductive layer will now be explained.

The charge generating layer comprises as the main component a charge generating material as the main component, with further addition of a binder resin when necessary.

As such a binder resin, polyamide, polyurethane, polyester, epoxy resin, polyketone, polycarbonate, silicone resin, acrylic resin, polyvinyl butyral, polyvinyl formal, polyvinyl ketone, polystyrene, poly-N-vinyl carbazole, and polyacrylamide.

As the charge generating material, the following can be employed in the present invention: Organic pigments, such as C.I. Pigment Blue 25 (C.I. 21180), C.I. Pigment Red 41 (C.I. 21200), C.I. Acid Red 52 (C.I. 45100), and C.I. Basic Red 3 (C.I. 45210); a phthalocyanine pigment having a prophyrin skeleton; an azeulenium salt pigment; a squaric pigment; an azo pigment having a carbazole skeleton (Japanese Laid-Open Patent Application No. 53-95033), an azo pigment having a styrylstilbene skeleton (Japanese Laid-Open Patent Application No. 53-138229), an azo pigment having a triphenylamine skeleton (Japanese Laid-Open Patent Application No. 53-132547), an azo pigment having a dibenzothiophene skeleton (Japanese Laid-Open Patent Application No. 54-21728), an azo pigment having an oxadiazole skeleton (Japanese Laid-Open Patent Application No. 54-12742), an azo pigment having a fluorenone skeleton (Japanese Laid-Open Patent Application No. 54-22834), an azo pigment having a bisstilbene skeleton (Japanese Laid-Open Patent Application No. 54-17733), an azo pigment having a distyryl oxadizaole skeleton (Japanese Laid-Open Patent Application No. 54-2129), an azo pigment having a distyryl carbazole skeleton (Japanese Laid-Open Patent Application No. 54-17734), a trisazo pigment having a carbazole skeleton (Japanese Laid-Open Patent Applications Nos. 57-195767 and 57-195768; a phthalocyanine-type pigment such as C.I. Pigment Blue 16 (C.I. 74100); Indigo-type pigments such as C.I. Vat Brown 5 (C.I. 73410) and C.I. Vat Dye (C.I. 73030); and perylene-type pigments such as Indanthrene Scarlet R (made by Bayer Co., Ltd).

The charge generating layer can be formed, for example, as follows:

A charge generating material, with further addition of a binder resin when necessary, is dispersed together with a solvent such as tetrahydrofuran, cyclohexanone, dioxane and dichloroethane, in a ball mill, an attritor, or a sand mill, to prepare a dispersion of the charge generating material. This dispersion, appropriately diluted, is coated on the support by a conventional coating method such as immersion coating and spray coating.

It is preferable that the thickness of the charge generating layer be in the range of about 0.01 μm to about 5 μm, more preferably in the range of 0.1 μm to 2 μm.

The charge transporting layer comprises as the main component a charge transporting material, with further addition of a binder resin when necessary. The charge transporting layer can be formed by coating a charge transporting material which is dissolved or dispersed in an appropriate solvent.

As the charge transporting material, there are a positive hole transporting material and an electron transporting material.

Specific examples of a positive hole transporting material are poly-N-vinylcarbazole and derivatives thereof, poly-γ-carbazolyl ethyl glutamate and derivatives thereof, pyrene-formaldehyde condensate and derivatives thereof, polyvinyl pyrene, polyvinyl phenanthrene, oxazole derivatives, oxadiazole derivates, imidazole derivatives, triphenylamine derivatives, 9-(p-diethylaminostyryl) anthracene, 1,1-bis-(4-dibenzylaminophenyl)propane, styryl anthracene, styryl pyrazoline, phenylhydrazone, and α-phenylstilbene derivatives, which are electron doners.

Examples of an electron transporting material are chloroanil, bromoanil, tetracyanoethylene, tetracyanoquinone dimethane, 2,4,7-trinitro-9-fluorenone, 2,4,5,7-tetranitro-9-fluorenone, 2,4,5,7-tetra-nitroxanthone, 2,4,8-trinitrothioxanthone, 2,6,8-trinitro-4H-indeno[1,2-b]thiophene-4-on, and 1,3,7-trinitrodibenzothiophenone-5,5-dioxide, which are electron acceptors. These materials can be employed alone or in combination.

As the binder resin for use in the present invention, the following thermoplastic and thermosetting resins can be employed: polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyacrylate resin, phenoxy resin, polycarbonate, cellulose acetate resin, ethylcellulose resin, polyvinyl butyral, polyvinyl-formal, polyvinyl toluene, poly-N-vinylcarbazole, acrylic resin, silicone resin, epoxy resin, melamine resin, urethane resin, phenolic resin, and alkyd resin.

As the solvent for preparing the coating dispersions of the charge generating layer and the charge transporting layer, tetrahydrofuran, dioxane, toluene, monochlorobenzene, dichloroethane, and methylene chloride can be employed.

It is preferable that the thickness of the charge transporting layer be in the range of about 5 μm to about 100 μm.

In the present invention, a plasticizer and a leveling agent may be added to the charge transporting layer.

As the plasticizer, conventional plasticizers such as dibuthyl phthalate and dioctyl phthalate may be employed. It is preferable that such a plasticizer be employed in an amount of 0 to about 30 wt. % to the binder resin in the charge transporting layer.

Further as the leveling agent, silicone oils such as dimethyl silicone oil and methylphenyl silicone oil may be employed. It is preferable that such a leveling agent be employed in an amount of 0 to about 1 wt. % to the binder resin in the charge transporting layer.

The present invention will now be explained in detail with reference to the following examples, which are given for illustration of the invention and are not intended to be limiting thereof.

EXAMPLE 1

A cylindrical support made of a novolak type phenol resin containing as fillers carbon, wood powder and an organic filler, having an outer diameter of 40 mm, a length of 270 mm and a thickness of 4 mm, was boiled in water for 5 hours, and dried, whereby the ammonia releasing rate therefrom was adjusted to be 50 ppm in the sense as described previously.

On this cylindrical support, an electroconductive layer made of aluminum was formed by vacuum deposition of aluminum with a thickness of about 1000 μm.

On the aluminum electroconductive layer, the following white pigment layer serving as intermediate layer, charge generating layer and charge transporting layer were successively overlaid:

(1) Formation of White Pigment Layer

A mixture of the following components was dispersed in a ball mill for 12 hours, whereby a white pigment layer coating liquid was prepared:

| | |
|---|---|
| Titanium oxide (Trademark "Tipaque" made by Ishihara Sangyo Kaisha, Ltd.) | 90 g |
| Electroconductive resin (Trademark "Chemistat 6120" made by Sanyo Chemical Industries, Ltd ) | 14.3 g |
| Polyamide resin (Trademark "CM-8000" made by Toray Industries, Inc.) | 142.5 g |
| Methanol | 625 g |
| Distilled water | 75 g |

The thus prepared white pigment layer coating liquid was coated on the aluminum electroconductive layer by immersion coating, and dried at 120° C. for 10 minutes, whereby a white pigment layer with a thickness of 4 μm was formed on the aluminum electroconductive layer.

(2) Formation of Charge Generating Layer

A mixture of the following components was milled in a ball mill for 48 hours, using SUS balls having a diameter of 10 mm:

| | |
|---|---|
| 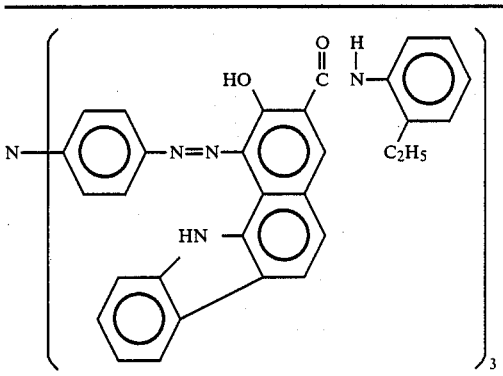 | 25 g |
| Butyral resin (Trademark "XYHL" made by Union Carbide Corp.) | 10 g |
| Cyclohexanone | 365 g |

To the above mixture, 600 g of cyclohexanone was added, and the mixture was further milled for 24 hours. Then the milled mixture was replaced from the ball mill into a container and diluted with cyclohexanone until the concentration of the solid components of the mixture became 2 wt. %, and stirred, whereby a charge generating layer coating dispersion was prepared.

The thus prepared charge generating layer coating dispersion was coated on the white pigment layer by immersion coating, and dried, whereby a charge generating layer with a thickness of 0.1 μm was formed on the white pigment layer.

(3) Formation of Charge Transporting Layer

A mixture of the following components was dispersed, whereby a charge transporting layer coating dispersion was prepared:

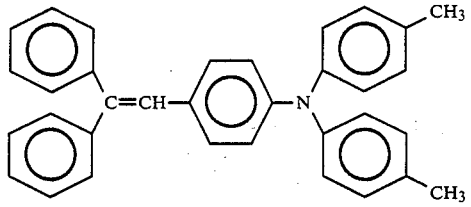

180 g

| | |
|---|---|
| Polycarbonate resin (Trademark "C-1400" made by Teijin Kasei Co., Ltd.) | 250 g |
| Silicone oil (Trademark "KF50" made by Shin-Etsu Chemical Co., Ltd.) | 0.04 g |
| Methylene chloride | 1250 g |

The thus prepared charge transporting layer coating dispersion was coated on the charge generating layer by immersion coating and dried, whereby charge transporting layer with a thickness of 20 μm was formed on the charge generating layer. Thus a cylindrical electrophotographic photoconductor No. 1 according to the present invention was prepared.

The cylindrical electrophotographic photoconductor No. 1 was negatively charged in the dark under application of −6 kV of corona charge, as the photoconductor was rotated at 1000 rpm, until the surface potential of the photoconductor became −800V, which surface potential is hereinafter referred to as the initial surface potential $V_i$ (V).

The photoconductor was illuminated by a tungsten lamp in such a manner that the slit width for the illumination by the tungsten lamp was 6 mm and the illuminance on the illuminated surface of the photoconductor was 26 lux/cm$^2$. Thus the exposure $E_{1/10}$ (lux sec) required to reduce the initial surface potential $V_i$(V), that is, −800V, of the photoconductor to 1/10 of the initial surface potential $V_i$ (V), that is, −80V, was measured.

With further exposure of the photoconductor to the same light by the same tungsten lamp for 30 seconds, the surface potential of the photoconductor, hereinafter referred to as the residual potential $V_R$, was measured.

By use of the above electrophotographic photoconductor, 2000 copies were made, and then the exposure $E_{1/10}$ (lux sec) and the residual potential $V_R$ were also measured.

| Electrophotographic Characteristics | Initial | After 2000 copies |
|---|---|---|
| $E_{1/10}$ (lux · sec) | 1.5 | 1.5 |

-continued

| Electrophotographic Characteristics | Initial | After 2000 copies |
|---|---|---|
| $V_R$ (V) | 5 | 10 |

EXAMPLE 2

The game cylindrical support with the same electroconductive aluminum layer deposited thereon as that employed in Example 1 was prepared.

On the aluminum electroconductive layer, the following white pigment layer, charge generating layer and charge transporting layer were successively overlaid:

(1) Formation of White Pigment Layer

A mixture of the following components was dispersed in a ball mill for 12 hours, whereby a white pigment layer coating liquid was prepared:

| | |
|---|---|
| Titanium oxide (Trademark "Tipaque" made by Ishihara Sangyo Kaisha, Ltd.) | 40 g |
| Polyamide resin (Trademark "CM-8000" made by Toray Industries, Inc.) | 40 g |
| Methanol | 1000 g |

The thus prepared white pigment layer coating liquid was coated on the aluminum electroconductive layer by immersion coating, and dried at 100° C. for 10 minutes, whereby a white pigment layer with a thickness of 1 μm was formed on the aluminum electroconductive layer.

(2) Formation of Charge Generating Layer

A mixture of the following components was milled in a ball mill for 48 hours, using SUS balls having a diameter of 10 mm:

Disazo pigment having the structural formula,

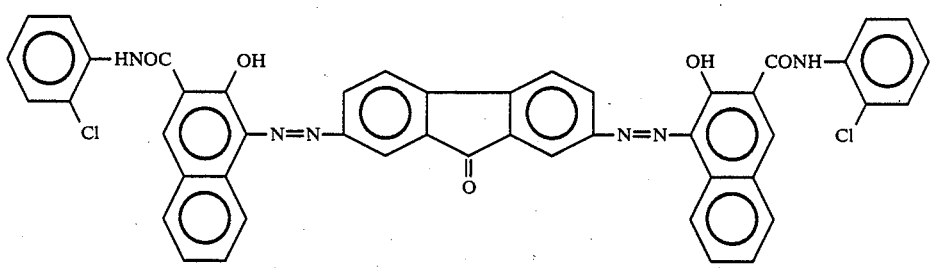

25 g

| | |
|---|---|
| 5 wt. % cyclohexanone solution of phenoxy resin (Trademark "PKHH" made by Union Carbide Corp.) | 100 g |
| Cyclohexanone | 475 g |

To the above mixture, 900 g of cyclohexanone was added, and the mixture was further milled for 1 hour. Then the milled mixture was replaced from the ball mill into a container and diluted with cyclohexanone until the concentration of the solid components of the mixture became 1 wt. %, and stirred, whereby a charge generating layer coating dispersion was prepared.

The thus prepared charge generating layer coating dispersion was coated on the white pigment layer by immersio coating, and dried, whereby a charge generating layer with a thickness of 0.2 μm was formed on the white pigment layer.

(3) Formation of Charge Transporting Layer

A mixture of the following components was dispersed, whereby a charge transporting layer coating dispersion was prepared:

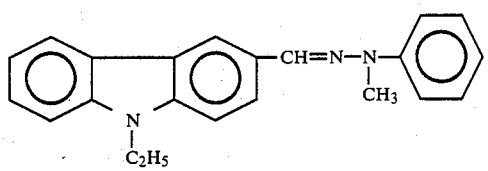

180 g

| | |
|---|---|
| Polycarbonate resin (Trademark "K-1300" made by Teijin Kasei Co., Ltd.) | 200 g |
| Silicone oil (Trademeark "KF50" made by Shin-Etsu Chemical Co., Ltd.) | 0.04 g |
| Methylene chloride | 1520 g |

The thud prepared charge transporting layer coating dispersion was coated on the charge generating layer by immersion coating and dried, whereby charge transporting layer with a thickness of 20 μm was formed on the charge generating layer. Thus a cylindrical electrophotographic photoconductor No. 2 according to the present invention was prepared.

The cylindrical electrophotographic photoconductor No. 2 was subjected to the same tests for examining the electrophotographic characteristics thereof as that performed in Example 1. The results were as follows:

| Electrophotographic Characteristics | Initial | After 2000 copies |
|---|---|---|
| $E_{1/10}$ (lux · sec) | 1.8 | 1.9 |
| $V_R$ (V) | 5 | 10 |

EXAMPLE 3

On a cylindrical support made of a resol type phenol resin containing carbon, wood powder and an organic filler, having an outer diameter of 40 mm, a length of 270 mm and a thickness of 4 mm, an electroconductive layer made of aluminum was formed by vacuum deposition of aluminum with a thickness of about 1000 μm.

On the aluminum electroconductive layer, the following white pigment layer, charge generating layer and charge transporting layer were successively overlaid;

(1) Formation of white Pigment Layer

A mixture of the following components was dispersed in a ball mill for 12 hours, whereby a white pigment layer coating liquid was prepared:

| | |
|---|---|
| Titanium oxide (Trademark "Tipaque" made by Ishihara Sangyo Kaisha, Ltd.) | 90 g |
| Electroconductive resin (Trademark "Chemistat 6120" made by Sanyo Chemical Industries, Ltd.) | 14.3 g |
| Polyamide resin (Trademark "CM-8000" made by Toray Industries, Inc.) | 142.5 g |
| Methanol | 625 g |
| Distilled water | 75 g |

The thus prepared white pigment layer coating liquid was coated on the aluminum electroconductive layer by immersion coating, and dried at 120° C. for 10 minutes, whereby a white pigment layer with a thickness of 4 μm was formed on the aluminum electroconductive layer.

(2) Formation of Charge Generating Layer

A mixture of the following components was milled in a ball mill for 48 hours, using SUS balls having a diameter of 10 mm:

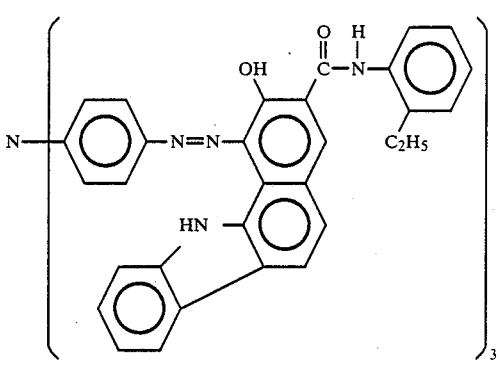

25 g

| | |
|---|---|
| Butyral resin (Trademark "XYHL" made by Union Carbide Japan K.K.) | 10 g |
| Cyclohexanone | 365 g |

To the above mixture, 600 g of cyclohexanone was added, and the mixture was further milled for 24 hours. Then the milled mixture was replaced from the ball mill into a container and diluted with cyclohexanone until the concentration of the solid components in the mixture became 2 wt. %, and stirred, whereby a charge generating layer coating dispersion was prepared.

The thus prepared charged generating layer coating dispersion was coated on the white pigment layer by immersion coating, and dried, whereby a charge generating layer with a thickness of 0.1 μm was formed on the white pigment layer.

(3) Formation of Charge Transporting Layer

A mixture of the following components was dispersed, whereby a charge transporting layer coating dispersion was prepared:

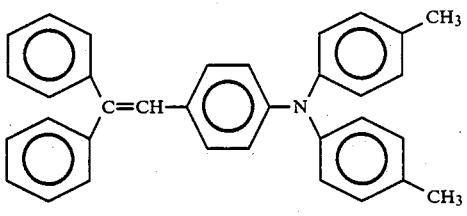

180 g

| | |
|---|---|
| Polycarbonate resin (Trademark "C-1400" made by Teijin Kasei Co., Ltd.) | 250 g |
| Silicone oil (Trademark "KF50" made by Shin-Etsu Chemical Co., Ltd.) | 0.04 g |
| Methylene chloride | 1520 g |

The thus prepared charge transporting layer coating dispersion was coated on the charge generating layer by immersion coating and dried, whereby charge transporting layer with a thickness of 20 μm was formed on the charge generating layer. Thus a cylindrical electrophotographic photoconductor No. 3 according to the present invention was prepared.

The cylindrical electrophotographic photoconductor No. 3 was subjected to the same tests for examining the electrophotographic characteristics thereof as that performed in Example 1. The results were as follows:

| Electrophotographic Characteristics | Initial | After 2000 copies |
|---|---|---|
| $E_{1/10}$ (lux · sec) | 1.0 | 1.0 |
| $V_R$ (V) | 0 | 5 |

EXAMPLE 4

The same cylindrical support with the same electroconductive aluminum layer deposited thereon as that employed in Example 1 was prepared.

On the aluminum electroconductive layer, the following white pigment layer, charge generating layer and charge transporting layer were successively overlaid:

(1) Formation of White pigment Layer

A mixture of the following components was dispersed in a ball mill for 12 hours, whereby a white pigment layer coating liquid was prepared:

| | |
|---|---|
| Titanium oxide (Trademark "Tipaque" made by Ishihara Sangyo Kaisha, Ltd.) | 40 g |
| Polyamide resin (Trademark "CM-8000" made by Toray Industries, Inc.) | 40 g |
| Methanol | 1000 g |

The thus prepared white pigment layer coating liquid was coated on the aluminum electroconductive layer by immersion coating, and dried at 100° C. for 10 minutes, whereby a white pigment layer with a thickness of 1 μm was formed on the aluminum electroconductive layer.

(2) Formation of Charge Generating Layer

A mixture of the following components was milled in a ball mill for 48 hours, using SUS balls having a diameter of 10 mm:

Disazo pigment having the structural formula

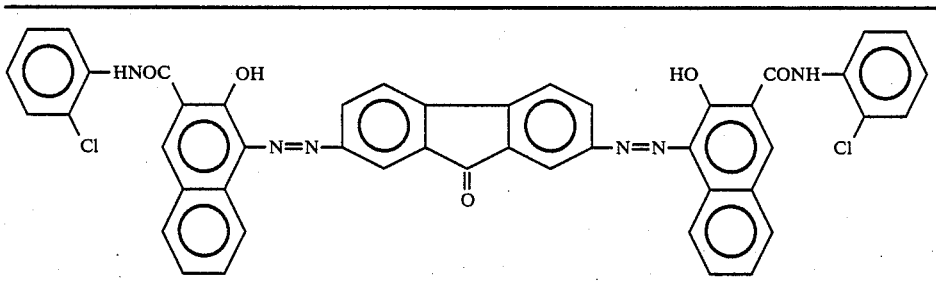

25 g

| | |
|---|---|
| 5 wt. % cyclohexanone solution of phenoxy resin (Trademark "PKHH" made by Union Carbide Corp.) | 100 g |
| Cyclohexanone | 475 g |

To the above mixture, 900 g of cyclohexanone was added, and the mixture was further milled for 1 hour. Then the milled mixture was replaced from the ball mill into a container and diluted with cyclohexanone until the concentration of the solid components in the mixture became 1 wt. % and stirred, whereby a charge generating layer coating dispersion was prepared.

The thus prepared charge generating layer coating dispersion was coated on the white pigment layer by immersion coating and dried, whereby a charge generating layer with a thickness of 0.2 μm was formed on the white pigment layer.

(3) Formation of Charge Transporting Layer

A mixture of the following components was dispersed, whereby a charge transporting layer coating dispersion was prepared:

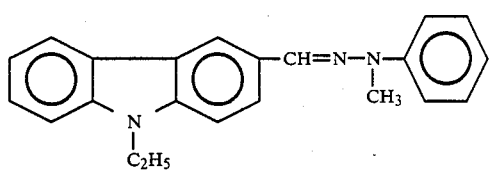

180 g

| | |
|---|---|
| Polycarbonate resin (Trademark "K-1300" made by Teijin Kasei Co., Ltd.) | 200 g |
| Silicone oil (Trademeark "KF50" made by Shin-Etsu Chemical Co., Ltd.) | 0.04 g |
| Methylene chloride | 1520 g |

The thus prepared charge transporting layer coating dispersion was coated on the charge generating layer by immersion coating and dried, whereby charge transporting layer with a thickness of 20 μm was formed on the charge generating layer. Thus a cylindrical electrophotographic photoconductor No. 4 according to the present invention was prepared.

The cylindrical electrophotographic photoconductor No. 4 was subjected to the same tests for examining the electrophotographic characteristics thereof as that performed in Example 1. The results were as follows:

| Electrophotographic Characteristics | Initial | After 2000 copies |
|---|---|---|
| $E_{1/10}$ (lux · sec) | 1.5 | 1.5 |
| $V_R$ (V) | 0 | 5 |

According to the present invention, an electrophotographic photoconductor with excellent electrophotographic characteristics and a minimized residual potential while in use can be provided at low cost.

What is claimed is:

1. In an electrophotographic photoconductor comprising a cylindrical electroconductive support, and a photoconductive layer formed on said cylindrical electroconductive support, the improvement wherein said cylindrical electroconductive support comprises a cylindrical base support made of a phenol resin, with the releasing rate of ammonia therefrom per 48 hours being 50 ppm or less.

2. The electrophotographic photoconductor as claimed in claim 1, wherein said cylindrical electroconductive support comprises said base support and an electroconductive layer formed thereon, and said photoconductive layer is formed on said electroconductive layer.

3. The electrophotographic photoconductor as claimed in claim 1, wherein said photoconductive layer comprises a charge generating material and a charge transporting material.

4. The electrophotographic photoconductor as claimed in claim 2, wherein said photoconductive layer comprises a charge generating material and a charge transporting material.

5. The electrophotographic photoconductor as claimed in claim 1, wherein said photoconductive layer comprises (a) a charge generating layer comprising a charge generating material and (b) a charge transporting layer comprising a charge transporting material.

6. The electrophotographic photoconductor as claimed in claim 2, wherein said photoconductive layer comprises (a) a charge generating layer comprising a charge generating material and (b) a charge transporting layer comprising a charge transporting material.

7. The electrophotographic photoconductor as claimed in claim 1, wherein said phenol resin is a resol type phenol resin.

8. The electrophotographic photoconductor as claimed in claim 1, wherein said electroconductive support further comprises carbon black.

9. The electrophotographic photoconductor as claimed in claim 1, wherein said electroconductive support further comprises carbon black and an organic filler.

* * * * *